United States Patent [19]

Kirsch

[11] Patent Number: 4,554,739

[45] Date of Patent: Nov. 26, 1985

[54] HEMMING RULE

[76] Inventor: Albert J. Kirsch, 5540 Wattsburg Rd., Erie, Pa. 16509

[21] Appl. No.: 586,700

[22] Filed: Mar. 6, 1984

[51] Int. Cl.[4] ..... A41H 1/00

[52] U.S. Cl. ..... 33/2 H

[58] Field of Search ..... 33/2 H, 464, 470, 468, 33/473

[56] References Cited

U.S. PATENT DOCUMENTS

| | | | |
|---|---|---|---|
| 714,404 | 11/1902 | Schaller | 33/468 |
| 944,094 | 12/1909 | Hilton | 33/2 H |
| 2,269,841 | 1/1942 | Blair | 33/470 |
| 2,493,618 | 1/1950 | Compiano | 33/2 H |
| 2,703,931 | 3/1955 | Collins | 33/2 H |
| 3,273,246 | 9/1966 | Siberini | 33/470 |
| 3,693,261 | 9/1972 | Moore | 33/469 |

FOREIGN PATENT DOCUMENTS

| | | | |
|---|---|---|---|
| 3712 | of 1910 | United Kingdom | 33/464 |

*Primary Examiner*—Willis Little

*Attorney, Agent, or Firm*—Ralph Hammar

[57] ABSTRACT

A measuring stick or rule which quickly provides a line along which a pant leg is to be cut and a line along which said pant leg is to be folded in order to provide the desired length.

1 Claim, 4 Drawing Figures

FIG. 1
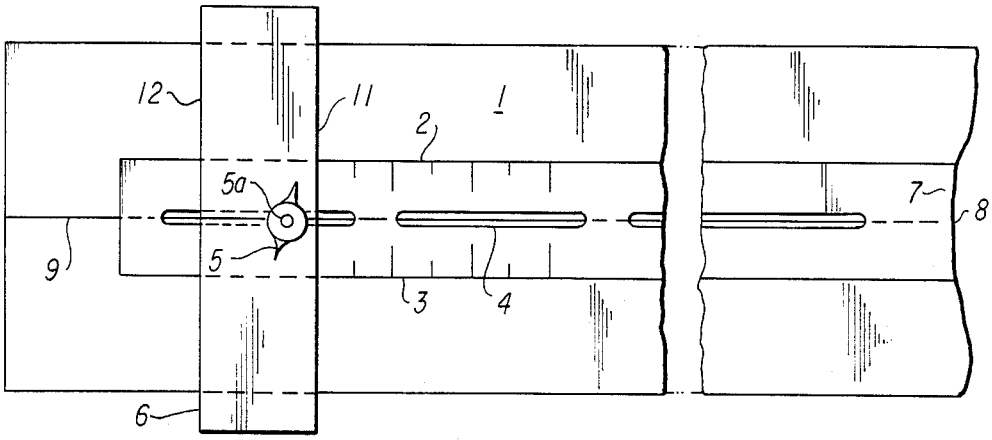
FIG. 2
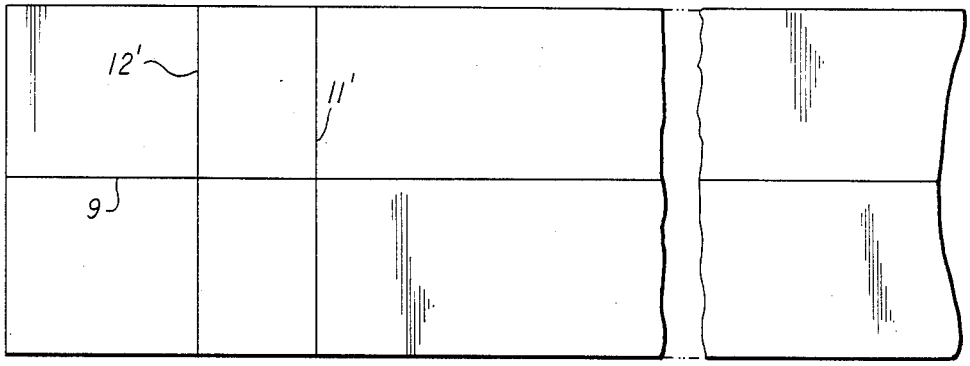
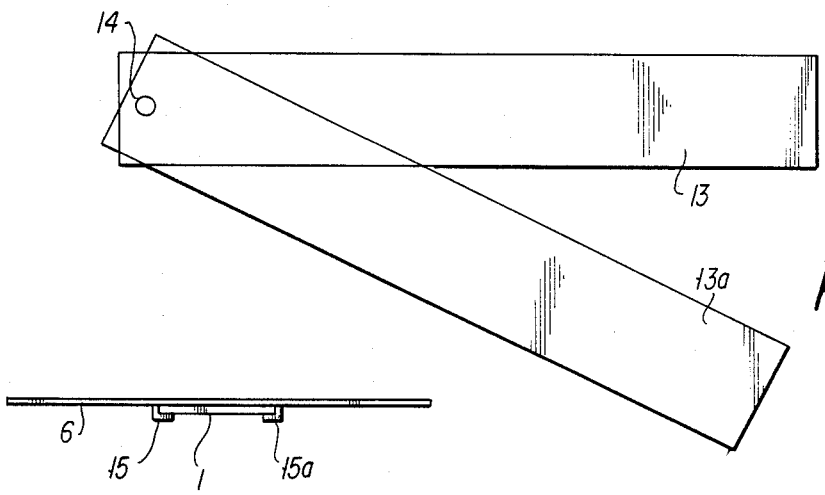
FIG. 3
FIG. 4

HEMMING RULE

Pants are commonly manufactured so that the length can be shortened but not lengthened. This invention is a measuring stick or rule which accurately determines the line along which the pant leg should be cut (the cut line) and the line along which the pant leg should be folded (the fold line) in order to provide the desired finished length.

In the drawing,

FIG. 1 is a plan view of the measuring stick or rule positioned on the inseam of a pant leg, FIG. 2 is a view showing the cut line and the fold line made with the rule of FIG. 1, FIG. 3 is a plan view of a folding rule which is easier to ship through the mails and FIG. 4 is an end view of a cross member with an alternate mounting on the rule.

The one piece length measuring stick or rule shown in FIG. 1 is intended for tailors and others who make a business of shortening pants. It is about 38 inches long and from one to two inches wide and is graduated along opposite edges 2, 3 in inches and centimeters. Along the center line of the rule are a plurality of elongated slots 4 slidably receiving a bolt 5*a* and wing nut 5 extending through a cross stick 6 having a length slightly greater than the widest pants to be shortened. To use the stick, the upper end 7 is lined up with the upper end 8 of the inseam 9. The stick is then laid flat along the pant leg with the slots 4 centered on the inseam. The cross stick 6 is slid up or down until the edge 10 lines up with the same length graduation on opposite edges of the stick corresponding to the desired finished length of the pants. This insures that the cross stick 6 will be precisely perpendicular to the length. The wing nut 5 is tightened locking the cross stick in the desired position and chalk lines are drawn along upper and lower edges 11, 12 of the cross stick. These chalk lines are respecively designated as 11' and 12' remain when the measuring stick is lifted off the pant leg. Line 12' is the cut line along which the pant leg shoud be cut to remove undesired surplus material. The pant leg is then turned inside out and the cut end is folded back along fold line 11' and either sewn or cemented to the inner surface of the pant leg in the usual manner.

The measuring stick may be made of any suitable material, wood, metal, plastic. The accuracy results from lining up the lengthwise measuring stick with the inner seam and aligning the cross stick with graduations on opposite edges of the measuring stick. This provides a high degree of accuracy independent of the skill of the user. In a preliminary test, shortening a pair of pants required 3 minutes from start to finish.

In order that complete coverage of the entire range of lengths may be obtained with the adjustment of the cross stick 6 relative to the lengthwise stick 1, of FIG. 1, the wing nut 5 is offset from the center line of the cross stick. By turning the cross stick 6 one hundred and eighty degrees relative to the wing nut from the position shown in FIG. 1, the offset will be on the opposite side of the center line of the cross stick. The amount of offset is large enough so that there are no dead spots in the adjustment range of the cross stick caused by spaced 4*a* between the slots 4.

For simplifying shipment by parcel post, the lengthwise measuring stick can be broken down into two or more pieces 13, 13*a* connected by a joint 14 as shown in FIG. 3. When the joint is made up, the measuring stick has the same function as the one piece measuring stick of FIG. 1.

FIG. 4 shows a modification in which the slots 4 are eliminated and the connection between the lengthwise measuring stick 1 and the cross stick 6 is made through a sliding joint 15, 15*a* between the cross stick 6 and the edges 2, 3 of the lengthwise stick 1.

When used for hemming pants, the cross stick 6 may be about $1\frac{1}{2}$ inches wide. When used for hemming curtains, the cross stick may be 4 to 5 inches wide.

I claim:

1. A rule for measuring pant legs and the like for shortening and hemming, comprising a lengthwise extending measuring stick having an upper end to be line up with the upper end of the inseam and two longitudinal side edges each provided with graduations in length units with graduations on one edge opposite like graduations on the other edge, said measuring stick further having a center line with elongated slots spaced from each other on said center line with elongated slots spaced from each other on said center line, a cross stick having upper and lower edges, the upper edge of the cross stick being nearer the upper end of the measuring stick, a pivot bearing between said upper and lower edges and offset to one side of the center line of the cross stick, a bolt extending through one of said slots and said pivot bearing, said cross stick by sliding of said bolt and pivoting of said cross stick on said bolt being adapted to be lined up with graduations on said lengthwise stick corresponding to the desired length, the lower edge of said cross stick when so lined up defining a cut line along which a cut should be made to remove surplus material and the upper edge of said cross stick defining a fold line along which material should be folded to produce the desired finished length.

* * * * *